US008376501B2

(12) United States Patent
DeJong et al.

(10) Patent No.: US 8,376,501 B2
(45) Date of Patent: Feb. 19, 2013

(54) REFLEX PRINTING

(75) Inventors: Joannes N. M. DeJong, Hopewell Junction, NY (US); Lloyd A. Williams, Mahopac, NY (US)

(73) Assignee: Xerox Corporation, Norwalk, CT (US)

( * ) Notice: Subject to any disclaimer, the term of this patent is extended or adjusted under 35 U.S.C. 154(b) by 209 days.

(21) Appl. No.: 12/881,304

(22) Filed: Sep. 14, 2010

(65) Prior Publication Data

US 2012/0062641 A1 Mar. 15, 2012

(51) Int. Cl.
*B41J 29/393* (2006.01)
*B41J 29/38* (2006.01)
*B41J 2/01* (2006.01)

(52) U.S. Cl. ..... 347/19; 347/16; 347/104

(58) Field of Classification Search ..... None
See application file for complete search history.

(56) References Cited

U.S. PATENT DOCUMENTS 5,231,428 A 7/1993 Domoto et al.
5,589,858 A * 12/1996 Kadowaki et al. ..... 347/14
7,467,838 B2 12/2008 Folkins et al.
7,665,817 B2 2/2010 Folkins et al.
2005/0263958 A1 12/2005 Knierim et al.
2006/0221124 A1 10/2006 Guarino et al.
2008/0124158 A1 * 5/2008 Folkins ..... 399/396

* cited by examiner

*Primary Examiner* — Geoffrey Mruk
(74) *Attorney, Agent, or Firm* — Fay Sharpe LLP

(57) ABSTRACT

The present disclosure provides for an imaging system comprising an image receiving surface which is moved in a downstream direction; a first marking station which applies a first image to the image receiving surface; and, a second marking station, downstream of the first marking station, which applies a second image to the image receiving surface. The imaging system further comprises a first measuring device at a first location at a beginning of a platen which outputs velocity measurement information related to the moving image receiving surface; a second measuring device at a second location at an end of the platen which outputs tension measurement information related to a tension increase in the media receiving surface between the first and second locations; and, a control system in communication with the first and second marking stations, the control system being configured for determining a modified actuation time of at least one of the first and second marking stations based on the information provided by the first and second measuring devices.

19 Claims, 4 Drawing Sheets

REFLEX PRINTING

BACKGROUND

The exemplary embodiment relates to registration of images in printing systems. It finds particular application in connection with a registration system for a multicolor printing system which compensates for fluctuations in the position of an image receiving surface between marking stations.

To provide accurate printing of images, multicolor digital marking systems need to maintain adequate color to color registration. In systems that utilize an elongate image receiving surface, such as a paper web or a belt, the receiving surface reaches a first marking station where a marking material of a first color is applied to the surface, e.g., by firing ink jets, exposing an image on a photoconductive material, or applying toner particles to a selectively imaged photoconductive member. The receiving surface then moves on to a second marking station, where an image or marking material of a second color is applied, and so forth, depending on the number of colors. The timing of the actuation of the second marking station can be controlled as a function of the speed of the image receiving surface so that the images applied by the two marking stations are registered one on top of the other to form a composite, multicolor image. A high degree of process direction alignment can be achieved by implementing what is generally known as reflex printing, where the speed or position of the image receiving surface is measured with an encoder at a certain location and then the images are timed accordingly. For example, an encoder is associated with a drive nip roller. The rotational speed of the roller is used to calculate the speed of the image receiving surface passing through the nip. The time for actuating the first, second, and subsequent marking stations is then calculated, based on their respective distances from the drive nip roller and the determined speed of the image receiving surface.

In the case of an electrophotographic printer, an encoder may be placed on the photoreceptor belt to measure the exact speed of the belt at each instant of time. The timing from this signal can then be used to time the firing of the laser raster output scanner (ROS) or light emitting diode (LED) bar so that an even spacing of lines is imaged on the photoreceptor, thus compensating for any variability in the photoreceptor speed from a set speed. In a multicolor system, the timing from the encoder can also be used to determine the exact time to fire successive color images to obtain good color on color registration, again compensating for any photoreceptor speed variations.

An implicit assumption of reflex printing systems is that the belt or web is infinitely stiff (i.e., it does not stretch or change length) such that the encoder measurement of the web or belt velocity enables an exact prediction of correct registration. In situations where the belt or web exhibits any sizeable amount of stretch or deformation, reflex printing techniques may still be subject to misregistration errors.

Image production systems often use a multitude of imagers in different locations along an image or paper transport path (e.g. belt loop, web . . . ). Each imager generates a separation, i.e. part of the total image (e.g. a particular color) at a particular location. The motion quality of the transport system between the imager locations determines the alignment of the separations (e.g. color registration) and the quality of the resulting image. Reflex printing measures the velocity of the image transport system and adjusts the imager timing to make the separations coincide. Double reflex printing measures the velocity of the image transport system in two different locations (e.g. before and after the imaging stations) to compensate for tension variation. Disadvantages of this method are: 1) this second velocity measurement is an additional expense, and 2) in many cases, the velocity measurement device measures the angular velocity of a somewhat compliant (e.g. rubber coated) drive roll that propels the image transport system. This measurement is known to be inaccurate which leads to a reduced quality of the produced image.

INCORPORATION BY REFERENCE

The following references, the disclosures of which are incorporated by reference in their entireties, are mentioned:

U.S. Pat. No. 5,231,428, entitled IMAGING DEVICE WHICH COMPENSATES FOR FLUCTUATIONS IN THE SPEED OF AN IMAGE RECEIVING SURFACE, by Domoto, et al., discloses a motion detector which monitors the speed of an imaging surface and determines a difference between the actual speed and the set speed.

U.S. Published Application No. 20050263958, entitled PRINT MEDIA registration USING ACTIVE TRACKING OF IDLER ROTATION, by Knierim, et al., discloses a sheet registration system for a moving sheets path for accurately correcting a sheet position relative to a desired sheet trajectory. The system includes a frictional sheet drive roller with a drive system and a mating undriven idler roller forming a nip therebetween. The undriven idler roller has a rotary encoder connected thereto to produce encoder electrical signals which are provided to a control system to control the drive system driving the frictional sheet drive roller.

U.S. Published Application No. 20060221124 entitled REFLEX printing WITH PROCESS DIRECTION STITCH ERROR CORRECTION, by Guarino, et al., discloses a reflex printing device having multiple print heads mounted at different angular locations around the circumference of the drum and an encoder disk mounted on the drum to allow for detection of the drum position as a function of time. An image defect due to a misalignment in the print process direction of the output from the multiple print heads is corrected by detection of an encoder position error function subtracted from itself shifted by the angle between the print heads.

U.S. Pat. No. 7,467,838 entitled SYSTEM AND METHOD FOR CONTROLLING A PRINT HEAD TO COMPENSATE FOR SUBSYSTEM MECHANICAL DISTURBANCES by Jeffrey J. Folkins, et al. discloses an apparatus which compensates for mechanical disturbances during a print process by adjusting the generation of image generating head actuation signals in anticipation of a mechanical disturbance. The apparatus includes a printer controller for generating signals to coordinate movement of components with a rotating image receiver in a printer and for generating data identifying a process disturbance arising from interaction of the rotating image receiver with the components and an expected time for the process disturbance, a process disturbance compensator for generating a process disturbance compensation signal that corresponds to the process disturbance identification and timing data, and an image generating head controller for adjusting an image generating head actuation signal with the process disturbance compensation signal.

U.S. Pat. No. 7,665,817 entitled DOUBLE REFLEX PRINTING by Jeffrey J. Folkins, discloses a registration system suited to use in an imaging system, such as an inkjet printer, includes a first measuring device, such as an encoder, which provides information for monitoring a speed of a moving image receiving surface of the imaging system, such as a paper web. A second measuring device, such as a second encoder or a tension measuring device, provides information for monitoring a tension in the image receiving surface. A control system determines an actuation time for one of two marking stations, based on the information from the first and second measuring devices. This enables a registration of images applied to the image receiving surface by the two marking stations to take into account both changes in speed of the web and changes in tension in the web.

BRIEF DESCRIPTION

The present disclosure provides for an imaging system comprising an image receiving surface which is moved in a downstream direction; a first marking station which applies a first image to the image receiving surface; and, a second marking station, downstream of the first marking station, which applies a second image to the image receiving surface. The imaging system further comprises a first measuring device at a first location at a beginning of a platen which outputs velocity measurement information related to the moving image receiving surface; a second measuring device at a second location at an end of the platen which outputs tension measurement information related to a tension increase in the media receiving surface between the first and second locations; and, a control system in communication with the first and second marking stations, the control system being configured for determining a modified actuation time of at least one of the first and second marking stations based on the information provided by the first and second measuring devices.

The present disclosure further provides for an imaging system comprising an image receiving surface which is moved in a downstream direction; a first marking station which applies a first image to the image receiving surface; and, a second marking station, downstream of the first marking station, which applies a second image to the image receiving surface. The imaging system further comprises a first measuring device at a first location which outputs velocity measurement information related to the moving image receiving surface; a second measuring device at a second location which outputs tension measurement information related to a tension increase in the media receiving surface between the first and second locations; and, a control system in communication with the first and second marking stations, the control system being configured for determining a modified actuation time of at least one of the first and second marking stations based on the information provided by the first and second measuring devices. The second measuring device in association with a second roller includes a servo motor, whereby the servo motor provides a torque in the second location to control the speed in the first location.

The present disclosure still further provides a method of registering images, comprising moving an image receiving surface; applying images to the image receiving surface at first and second spaced image applying positions; monitoring a speed of the image receiving surface at a first monitoring position spaced upstream from the first and second image applying positions; monitoring a tension in the image receiving surface at a second monitoring position spaced downstream from the first and second image applying positions; and, controlling a timing of at least one of the application of the first and second images in response to the monitored speed and tension in the image receiving surface.

DETAILED DESCRIPTION

Aspects of the exemplary embodiments relate to an imaging device and to a registration system for an imaging device. The imaging device includes an extensible image receiving member, such as a web or belt, which defines an image receiving surface that is driven in a process direction between marking stations. The process direction speed of the image receiving surface may vary over its length from a nominal set speed due, for example, to variations in stretch or deformation of the image receiving member and may vary over time due, for example to minor variations in the drive speed. The imaging surface thus has two degrees of freedom, defined by its speed and relative stretch in the receiving member.

The imaging device can include any device for rendering an image on print media, such as a copier, laser printer, bookmaking machine, facsimile machine, or a multifunction machine, all of which may generally be referred to as printers. The operation of applying images to print media, for example, graphics, text, photographs, etc., is generally referred to herein as printing or marking.

The image receiving member can be a web of print media, such as a continuous web of print media having a length substantially greater than its width and substantially greater than the distance between first and second marking stations. The print media can be paper, plastic, or other suitable physical print media substrate for images. Alternatively, the image receiving member can be a flexible belt, such as a photoreceptor belt, which may be in the form of a loop. Images applied to the belt at the first and second marking stations are transferred to a sheet of print media at a transfer station. In general, the web of print media or belt is one which has sufficient extensibility in the process direction that differences in tension in the web can result in misregistration of images applied by the first and second print stations. While the image receiving member will frequently be described herein in terms of a web of paper, it is to be appreciated that other image receiving members are also contemplated.

As used herein, an image can comprise a pattern of applied marking medium such as ink or toner. Or, the image may comprise a latent image, such as may be formed by exposing (e.g., discharging) portions of a photoreceptor belt surface, to which a marking medium such as a toner is subsequently applied.

Figure 1:
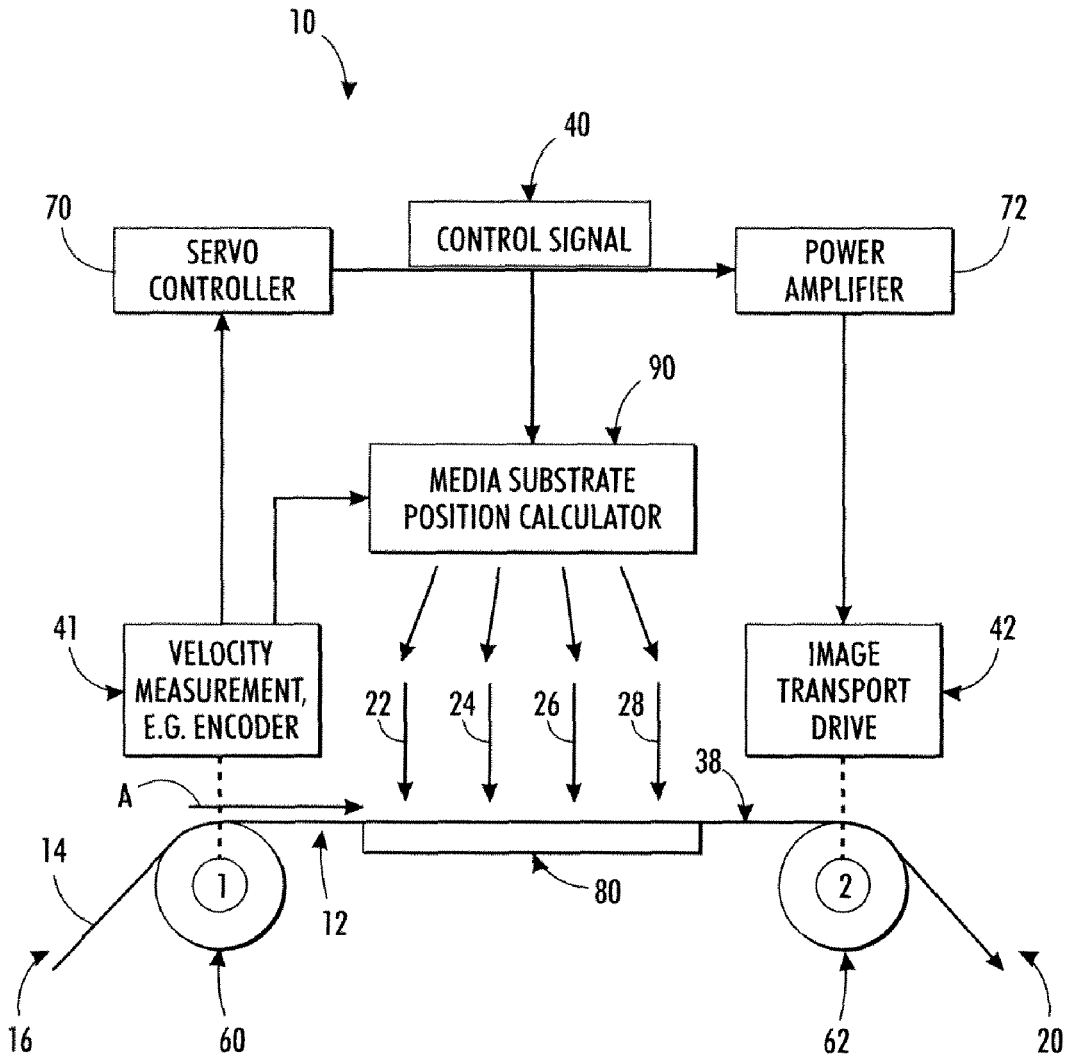
FIG. 1 is a schematic view of an imaging device in accordance with one aspect of the exemplary embodiment.

With reference to FIG. 1, a first embodiment of a multicolor digital marking system 10 is illustrated in the form of an ink jet printing system. The system 10 includes a conveyor system 12, which conveys a web 14 of paper along a paper path in a process direction indicated generally by arrow A, between an upstream end 16 and a downstream end 20, such as a take up roller (not shown). The printing system 10 includes a plurality of marking stations 22, 24, 26, 28, one for each of the ink colors to be applied, cyan, magenta, yellow, and black. The marking stations 22, 24, 26, 28 are arranged at spaced locations along the paper path. Each of the marking stations 22, 24, 26, 28 includes a print head (not shown) respectively, which applies a marking media, ink in the illustrated embodiment, to an imaging surface 38 defined by one side of the paper. The print heads 30, 32, 34, 36 are under the control of a control signal 40, which controls the firing of the print heads such that an image generated by the second marking station 24 (and subsequent marking stations 26, 28) is superimposed over an image applied by the first marking station 22. The control signal 40 may comprise a central processing unit (CPU) which executes instructions stored in associated memory for generating firing times/adjustments for the print heads, or the control signal may be another suitable computer controlled device. In one embodiment, the control signal 40 may form a part of an overall control system for the imaging device 10, which also provides image data to the marking stations.

The illustrated conveyor system 12 includes a plurality of guide members such as rollers, which guide the paper web 14 past the marking stations, generally through contact with the web. At least one of the rollers 42 is a drive roller which is driven in the process direction by a motor or other suitable drive system (not shown). The drive roller 42 can include a pair of rollers to form a drive nip therebetween. The driven roller 42 applies a driving force to the paper web as it passes through the nip. The drive motor is configured for driving the drive roller 42, and hence paper web 14, at a substantially constant preset speed. However, the speed of the driven roller 42 may fluctuate over time, i.e., vary from its preset speed, such that the speed of the web passing through the nip also fluctuates slightly over time. In the illustrated embodiment, the print heads 22, 24, 26, 28 are spaced along the paper path at various distances upstream from the nip.

One or more rollers (not shown) downstream and/or upstream of the driven roller 42 may be tension rollers. The tension rollers attempt to maintain a constant tension on the web 14 without applying a driving force. The tension rollers may be biased towards the web 14 to create a small amount of tension in the web to keep the web taut as it moves through the printing system 10. The tension applied to the web results in a minor amount of stretching of the web in the process direction. Variations in the tension may occur over time. As a result, the speed of the web at the print heads may vary over time (either higher or lower) from that at the nip.

Information on the web 14 is obtained at two spaced monitoring positions along the paper path, which enables both the web speed and the tension of the web to be factored into a relative firing time of successive print heads. In one embodiment, the information is obtained at a first web position downstream of all the print heads, and at a second web position upstream of all the print heads. However, the locations of first and second positions can be anywhere along the paper path where information on web speed and tension in the paper path adjacent the heads can be obtained. In other systems where the drive nip is upstream of the heads, downstream information may be useful.

To be described in more detail hereinafter, an apparatus can compensate for mechanical disturbances during a print process by adjusting the generation of image generating head actuation signals in anticipation of a mechanical disturbance. The apparatus can include a printer controller for generating signals to coordinate movement of components with a rotating image receiver in a printer and for generating data identifying a process disturbance arising from interaction of the rotating image receiver with the components and an expected time for the process disturbance, a process disturbance compensator for generating a process disturbance compensation signal that corresponds to the process disturbance identification and timing data, and an image generating head controller for adjusting an image generating head actuation signal with the process disturbance compensation signal.

The exemplary registration system includes a first measuring device 60 and a second measuring device 62. The first and second measuring devices 60, 62 can provide time varying and tension varying information related to the web, e.g., information from which its process direction speed and/or a tension in the web 14 can be derived and monitored as it changes over time. The first measuring device 60 may be at a first monitoring position and the second measuring device 62 may be at a second monitoring position, spaced from the first position in the process direction to provide information on the web 14 at first and second spaced positions of the web 14. The first measuring device 60 may be upstream of the second measuring device 62. In general, one of the first and second measuring devices 60, 62 is positioned upstream of at least one of the marking stations and the other of the first and second measuring devices 60, 62 is positioned downstream of at least one of the marking stations.

To be described in more detail hereinafter, a device and a method is provided to compensate for position errors due to tension variations in the media substrate in a section of a media transport system. The method can use one velocity measurement device and one tension measurement. The velocity measurement and the tension measurement can be located at opposite ends of a section of the media transport system (e.g. before and after the imaging zone). A servo control loop can measure the velocity in a first location and a servo drive system provides a torque to a drive roll in a second location to control the velocity in the first location. Increase in drag or external forces onto the transport system will cause a stretch and resulting position error. The increase in controller signal of the servo drive system is substantially proportional to the tension increase in the media substrate between the first and second location. Thus, the known controller signal is a function of media displacement due to stretch and can be used (together with the velocity measurement) to accurately predict the arrival of the media substrate at a particular location.

The device and method of the present disclosure are not limited to an image production system. They can be used in any device or system that needs an accurate prediction of the media substrate position at a particular location. Referring again to FIG. 1, a section of transport system components is therein displayed comprising transport media 14, media transport velocity measurement 41 (near location 1), transport drive system 42 (near location 2), a servo controller 70, and a section between locations 1 and 2 where image generation or other functions may occur. Examples of transport media comprise a web 14 made of paper, plastic, or other material, a belt loop made of photoreceptive material, intermediate material, plastic or other material, a web or belt loop transporting a sheet of paper or other material. The sheet may be in contact with the web or belt loop through a vacuum, electro-static forces, gripper bars, or other methods.

Measuring the media transport velocity 41 can include a rotary encoder attached to a roller, and/or a laser Doppler surface measurement. The transport drive system 42 can comprise a DC motor, AC motor, stepper motor, hydrostatic drive, or other actuator (gear belt, or other transmission), a power amplifier 72 that provides actuation power for the actuator through amplification (and sometimes conversion) of the low power control signal. The servo controller 70 can control velocity of the transport signal via outputting a control signal to the power amplifier. The diagram of FIG. 1 shows four imaging stations which can generate the CMYK, 22, 24, 26, 28; respectively, image separations of a color image. Xerographic, inkjet, or other imaging methods can be used. The transport media can be supported or held down against a platen 80 (vacuum), backer bars, or other support structures that exert a significant drag force onto the image transport system. Other forces from mechanical devices can also be applied in the section between locations 1 and 2.

A device and a method that calculates the position of the media substrate (i.e., media substrate position calculator 90) will be described hereinafter. In one exemplary arrangement, the calculator 90 can use one velocity measurement and one tension measurement calculated from the control signal output from the servo controller 70. Forces between location 1 and 2 change the tension in the media substrate. The elasticity of the media substrate causes an equivalent displacement, the magnitude of which can be determined by the modulus of elasticity of the media substrate. This media substrate displacement can cause successive operations (e.g. image generation) on the same point of the media substrate to be in error (e.g. introduce a color registration error).

Forces between location 1 and 2 can also change the required force exerted by the image transport drive system. In conventional systems this force is transmitted to the media substrate through a drive roll 2. When the force is substantial, a rubber coating may be applied to the drive roll to increase its coefficient of friction to prevent slip. The elasticity of the rubber coating changes the ratio of substrate surface velocity to drive roll angular velocity. Hence, a velocity measurement method, that relies on using drive roll angular velocity measurement can be in error.

Figure 2:
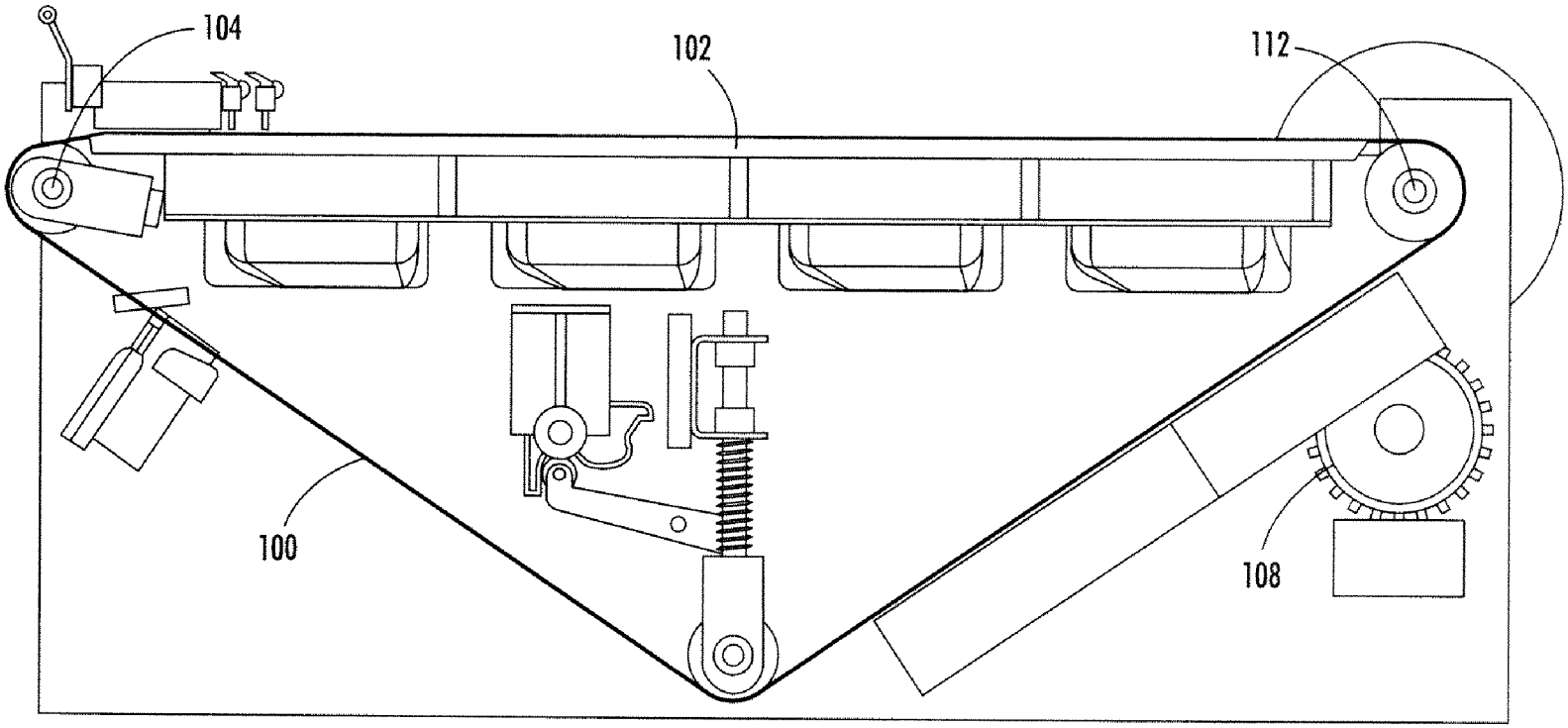
FIG. 2 is an elevational view of the imaging device including a belt loop system in accordance with FIG. 1.
Figure 3:
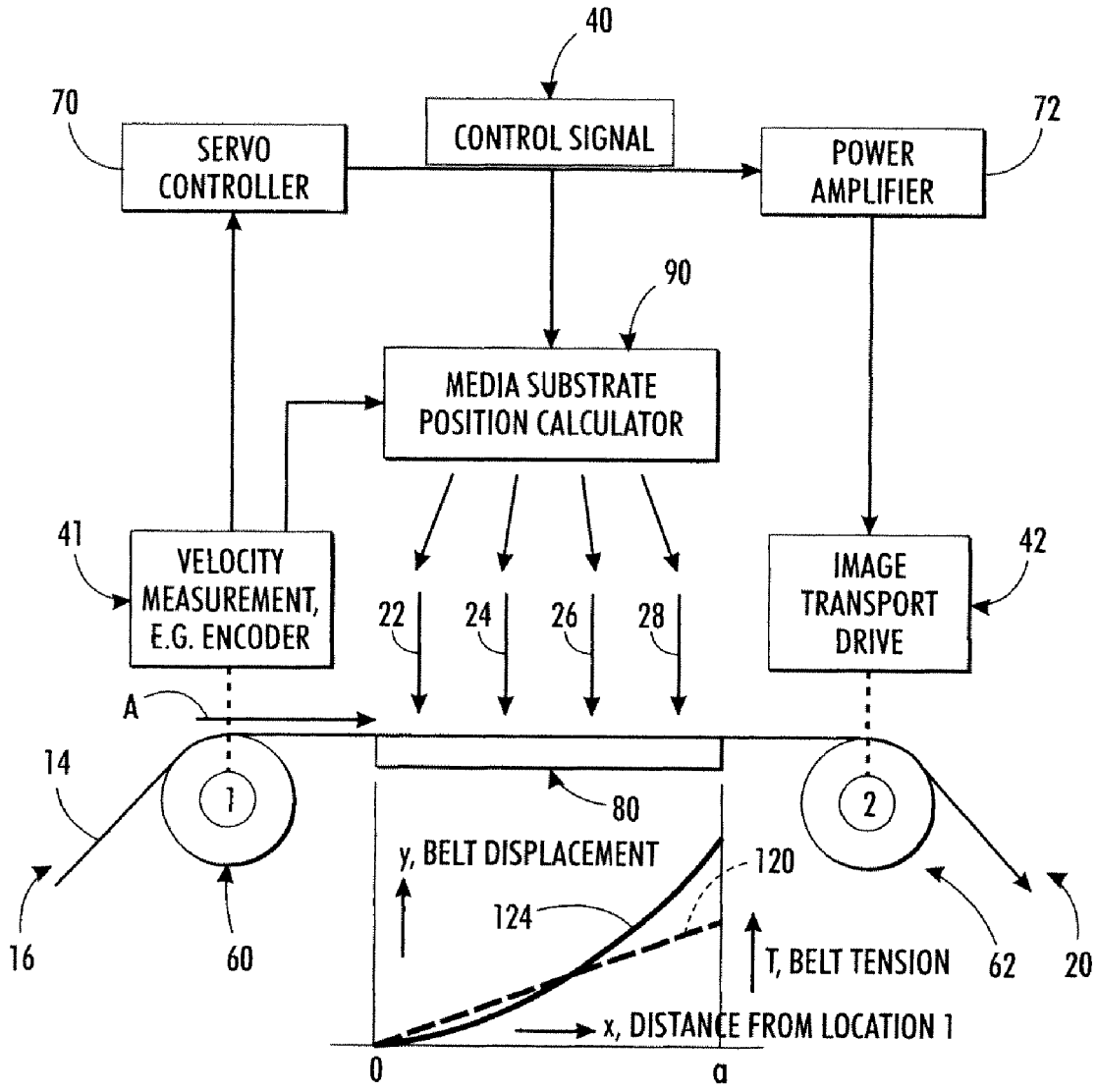
FIG. 3 is a schematic view of a registration system including a belt displacement diagram for the imaging device of FIG. 1; and, FIG. 4 is a chart displaying a control signal as a function of plenum vacuum pressure.

Referring to FIG. 2, an entire belt loop system in which the present disclosure can be applied is therein displayed. A transport belt loop 100 with holes can travel over a vacuum plenum 102. Sheets can be fed onto the belt near a steering roll 104. The vacuum forces the sheet into intimate contact with the belt 100 and forces the belt 100 into intimate contact with the plenum surface 102. Above the plenum are image stations (not shown). A drive motor 108 propels the transport belt 100 through a rubber coated roller 112. An encoder can be attached to the steering roller 104. The force of the vacuum that forces the belt 100 and plenum 102 into intimate contact can be substantial. Hence, the drag force on the belt 100 can be large. A schematic representation of the above is shown in FIG. 3.

In a conventional reflex printing system, the web speed, in the process direction, is determined from a single encoder. In the conventional system, it is assumed that the speed of the web at the print heads spaced from the encoder is the same as the web speed at the encoder. The heads of each color are then each fired sequentially a set number of encoder pulses apart, based on the determined speed. Absent stretching of the web, the color on color registration should generally be compensated for by this method. However, due to time varying changes in tension of the web, this assumption fails to provide accurate registration throughout printing.

Paper, for example, is a very stretchable medium. A 75 gram per square meter (gsm) paper typically has a Young's Modulus such that at a typical one pound per inch (approximately 0.18 kg/cm) web tension will cause the paper web to stretch by about 0.1%. In a system with an 0.8 m separation between print heads, such a stretch can represent about an 800 μm position difference. In a conventional system, the firing of a second print head is adjusted to reflect the stretch in the web at the time a test print is obtained by adjusting the firing until lines produced by the first and second print heads are aligned. However, the tension in the web can vary over time. A 20% change in tension, for example, may result in a misregistration of about 160 μm using the conventional single reflex registration control. In a printing system operating at 600 lines per inch, for example, the lines are about 42 μm apart. Accordingly, a misregistration of 160 μm is significant and is typically noticeable to the unaided eye of an observer examining the image. In the exemplary embodiment, the misregistration can generally be reduced such that it is maintained at less than the width of a scan line, and can, in theory, be compensated for completely.

In one exemplary arrangement, the drag force on the belt can be uniform along the back-up platen 80 and zero everywhere else. In this case, the belt tension (T) changes linearly with distance as shown in dashed line 120 in FIG. 3. The belt displacement (y) due to drag force is as shown in curve 124 in FIG. 3. The belt displacement (y) is zero until the start of the platen (x=0) and quadratic until the end of the paten (x=a). For a belt with modulus of elasticity of E [N/m] and applied drag force of F [N/m]. The equation for belt displacement, (y), is:

$$y=0.5*(F/E)*x^2/a;\ \text{where } x<a.$$

The equation above and integration of the velocity measurement at location 1, predicts the arrival of any point Z of the belt at a particular location. If imaging occurs at this particular point, then the image value associated with point Z can be put down in the correct location.

Note that the equation above involves knowing the drag force F. The drive motor 108 can supply a torque to overcome the drag force. To do so, the servo controller 70 can supply a control signal 40 to the power amplifier 72 to provide sufficient motor current. The increase in control signal is a function of the increase in drag force. In many cases, this relation is approximately linear.

Figure 4:
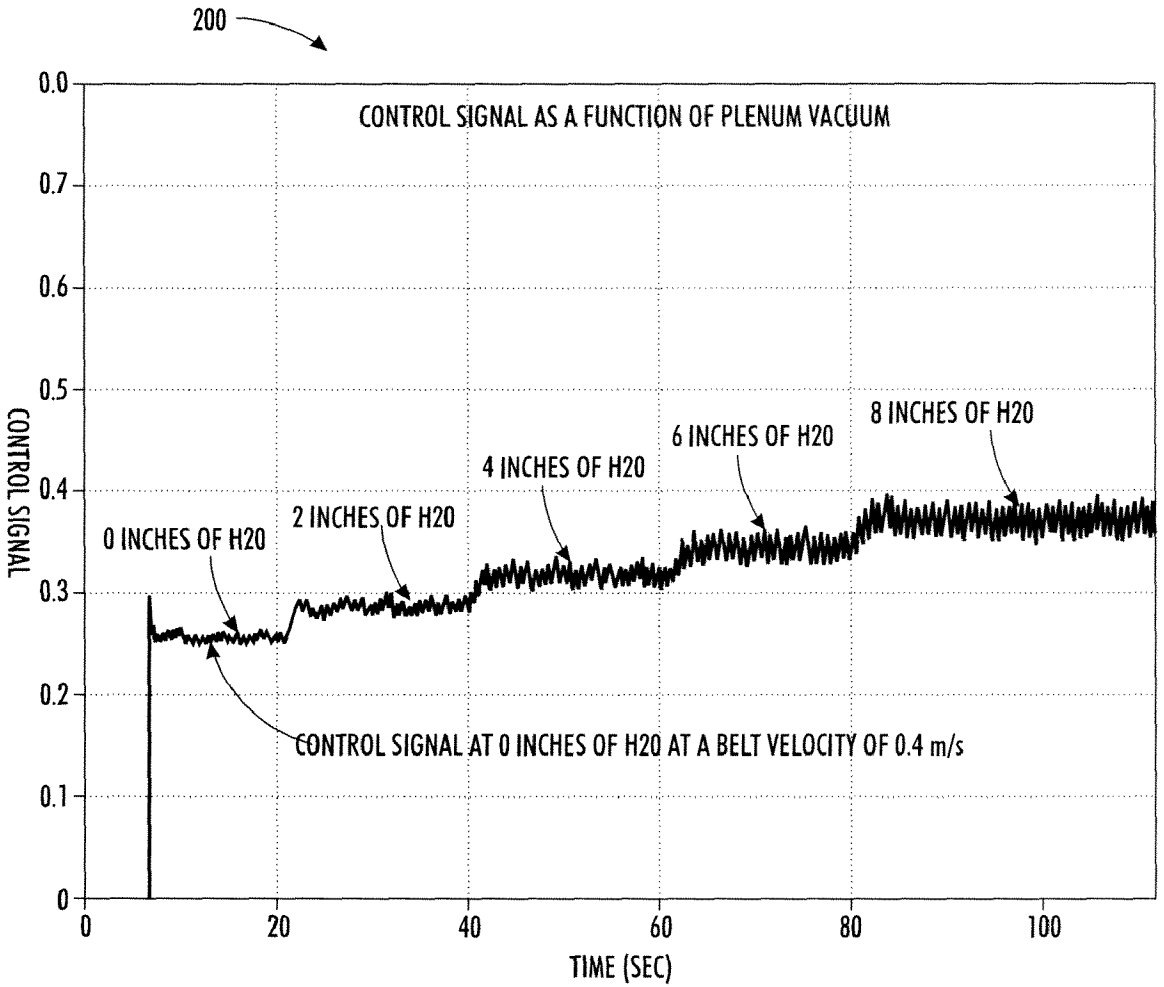

FIG. 4 shows the result of an experiment 200. In the experiment, the vacuum pressure in the plenum was increased from 0 inches of water to 8 inches of water, in incremental steps of 2 inches of water. The associated control signal increased from 0.26 to 0.37 in steps of 0.02525. This change in control signal is proportional to drag force F and belt tension (T). The proportionality constant can be calculated from the power amplifier 72, the motor torque constant and drive transmission ratio or can be obtained by calibration.

The above assumed a constant drag profile over the platen length. Other components in the section may exhibit a different longitudinal force profile onto the belt. The displacement calculation can be done similarly to the calculation above.

As discussed above, a transport section is provided in which a process direction force profile is applied between a first location and a second location. The transport velocity is measured in the first location and a servo motor provides a torque in a second location to control the speed in the first location. The process position of the transport media can be predicted by using the velocity measurement at a first location and the servo controller control signal applied to the power amplifier for the motor in a second location.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. An imaging system comprising:

a transport belt loop including an image receiving surface thereon, wherein the image receiving surface is moved in a downstream direction;

a first marking station which applies a first image to the image receiving surface;

a second marking station, downstream of the first marking station, which applies a second image to the image receiving surface;

a first measuring device at a first location at a beginning of a marking section which outputs velocity measurement information related to the moving image receiving surface;

a second measuring device at a second location at an end of the marking section which outputs tension measurement information related to a tension increase in the media receiving surface between the first and second locations;

a device member propels the transport belt loop around an elastic coated roller thereby increasing a drag force (F) on the transport belt loop;

the drag force displacing the transport belt loop and the image receiving surface thereon;

wherein the second measuring device calculates the transport belt displacement (Y) based on the drag force (F) according to:

$Y=0.5*(F/E)*x^2/a$; where,

F equals applied drag force,

E equals the modulus of elasticity of the image receiving surface, a equals the position at the end of the marking section, and, x equals the distance from the first location; and, a control system in communication with the first and second marking stations, the control system being configured for determining a modified actuation time of at least one of the first and second marking stations based on the information provided by the first and second measuring devices.

2. The imaging system of claim 1, wherein the first measuring device is upstream of the first and second marking stations and the second measuring device is downstream of the first and second marking stations.

3. The imaging system of claim 1, wherein the image receiving surface is defined by an extensible medium.

4. The imaging system of claim 1, wherein the imaging receiving surface comprises a surface of a print medium.

5. The imaging system of claim 4, wherein the print medium comprises a paper web.

6. The imaging system of claim 1, wherein the imaging receiving surface comprises a surface of the belt, the images being transferred from the belt to a print medium.

7. The imaging system of claim 1, further comprising a drive nip for moving the image receiving surface and wherein the measuring devices are located no further from the marking stations than the drive nip.

8. The imaging system of claim 1, wherein the first measuring device provides information which enables a variation in at least one of speed and position of the image receiving surface to be monitored and the second measuring device provides information which enables monitoring of a variation in tension of the image receiving surface.

9. The imaging system of claim 1, wherein the first measuring device is selected from the group consisting of an encoder and laser Doppler surface measurement.

10. The imaging system of claim 9, wherein the first measuring device comprises an encoder associated with a first roller which rotates as the imaging receiving surface travels in the downstream direction.

11. The imaging system of claim 10, wherein the first roller is upstream of the first and second marking stations.

12. The imaging system of claim 1, wherein the second measuring device in association with a second roller including a servo motor, whereby the servo motor provides a torque in the second location to control the speed in the first location.

13. The imaging system of claim 12, wherein a process direction force profile is applied between the first location and the second location.

14. The imaging system of claim 1, wherein integration of the velocity measurement and the transport belt displacement, predict the arrival of any point of the transport belt at a particular location.

15. An imaging system comprising:

a transport belt loop including an image receiving surface thereon which is moved in a downstream direction;

a first marking station which applies a first image to the image receiving surface;

a second marking station, downstream of the first marking station, which applies a second image to the image receiving surface;

a first measuring device at a first location which outputs velocity measurement information related to the moving image receiving surface;

a second measuring device at a second location which outputs tension measurement information related to a tension increase in the media receiving surface between the first and second locations;

a device member propels the transport belt loop around an elastic coated roller thereby increasing a drag force (F) on the transport belt loop;

the drag force displacing the transport belt loop and the image receiving surface thereon;

wherein the second measuring device calculates the transport belt displacement (Y) based on the drag force (F) according to:

$Y=0.5*(F/E)*x^2/a$; where,

F equals applied drag force,

E equals the modulus of elasticity of the image receiving surface, a equals the position at the end of the marking section, and, x equals the distance from the first location;

a control system in communication with the first and second marking stations, the control system being configured for determining a modified actuation time of at least one of the first and second marking stations based on the information provided by the first and second measuring devices; and, the second measuring device in association with the elastic coated roller including a servo motor, whereby the servo motor provides a torque in the second location to overcome the drag force and to control the speed in the first location.

16. The imaging system of claim 15, wherein a process direction force profile is applied between the first location and the second location.

17. The imaging system of claim 15, wherein the first and second marking stations comprise print heads which eject ink onto the image receiving surface to form the images.

18. The imaging system of claim 15, wherein the servo motor supplies a control signal to a power amplifier; and an increase to the control signal is a function of an increase to the drag force.

19. The imaging system of claim 15, wherein integration of the velocity measurement and the transport belt displacement, predict the arrival of any point of the transport belt at a particular location.

* * * * *